US008007323B1

(12) United States Patent
Yao et al.

(10) Patent No.: US 8,007,323 B1
(45) Date of Patent: Aug. 30, 2011

(54) HDMI CONNECTOR WITH FASTENING PORTIONS OF TERMINALS INSERT MOLDED IN INSULATING BODIES

(75) Inventors: Kun-Lin Yao, Guang-Dong (CN); Kai-Hsiang Chang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/946,862

(22) Filed: Nov. 16, 2010

(51) Int. Cl.
*H01R 24/00* (2011.01)

(52) U.S. Cl. ..... 439/660

(58) Field of Classification Search ..... 439/660, 439/493, 626, 357, 607.17, 604
See application file for complete search history.

(56) References Cited

U.S. PATENT DOCUMENTS 6,210,218 B1 * 4/2001 Chang ..... 439/567
6,685,486 B1 * 2/2004 Zhang et al. ..... 439/79
6,814,612 B1 * 11/2004 Hu et al. ..... 439/541.5
7,025,632 B2 * 4/2006 Hu et al. ..... 439/606
7,618,293 B2 * 11/2009 Wu ..... 439/660
7,909,653 B1 * 3/2011 Wan et al. ..... 439/660
2011/0034062 A1 * 2/2011 Wu ..... 439/350

* cited by examiner

*Primary Examiner* — Chandrika Prasad
(74) *Attorney, Agent, or Firm* — Cheng-Ju Chiang

(57) ABSTRACT

An HDMI (High Definition Multimedia Interface) connector includes an insulating housing which has a receiving cavity and an inserting mouth. A connecting body is formed between the receiving cavity and the inserting mouth and defines two rows of passing holes. An insulating body is secured in the receiving cavity and includes a first insulating body and a second insulating body engaged with the first insulating body. A plurality of first signal terminals and a plurality of second signal terminals each have a fastening portion, a contacting portion and a flexible portion. The first signal terminals are integrated with the first insulating body by means of insert molding the corresponding fastening portions in the first insulating body and the second signal terminals are integrated with the second insulating body by means of insert molding the corresponding fastening portions in the second insulating body. The flexible portions are elastically received in the corresponding passing holes.

10 Claims, 7 Drawing Sheets

HDMI CONNECTOR WITH FASTENING PORTIONS OF TERMINALS INSERT MOLDED IN INSULATING BODIES

BACKGROUND OF THE INVENTION

1. Field of the Invention

The present invention relates to a connector, and particularly to an HDMI (High Definition Multimedia Interface) connector.

2. The Related Art

In mobile communication field, an HDMI (High Definition Multimedia Interface) acted as a transmission interface is developed for multimedia audio video systems, such as DVD players, game box converters and TV boxes etc. The speed of transmitting signals of the HDMI can reach more than 5 Gbps. The HDMI connector not only can transmit audio signals and video signals which need not be compressed, but also can effectively transmit digital signals and analog signals at the same time without transforming one signal to another signal, so the HDMI connector is widely used in electronic products.

A conventional HDMI connector includes an insulating housing, an insulating body and a plurality of signal terminals. The insulating body defines two rows of terminal grooves. The signal terminals are disposed in the terminal grooves of the insulating body by means of assembling. The insulating body with the signal terminals is secured in the insulating housing. However, since all of the signal terminals are divided into two rows corresponding to the terminal grooves opened in the insulating body. In order to exactly assemble the two rows of the signal terminals in the corresponding terminal grooves of the insulating body, the assembling position between the insulating body and each row of signal terminals must be exactly controlled to ensure the signal terminals being exactly assembled in the terminal grooves in alignment with one another. Such manner would make the process of manufacturing the HDMI connector extremely complex and difficult. Furthermore, the finished HDMI connector has a lower qualified rate.

SUMMARY OF THE INVENTION

Accordingly, an object of the present invention is to provide an HDMI connector. The HDMI connector includes an insulating housing which has a receiving cavity opened at one end thereof and an inserting mouth opened at the other end thereof and opposite to the receiving cavity. A connecting body is formed between the receiving cavity and the inserting mouth and defines two rows of passing holes each connecting the receiving cavity with the inserting mouth. An insulating body is secured in the receiving cavity of the insulating housing and includes a first insulating body and a second insulating body engaged with the first insulating body. A plurality of first signal terminals and a plurality of second signal terminals each have a fastening portion, a contacting portion and a flexible portion connecting the fastening portion with the contacting portion. The first signal terminals are integrated with the first insulating body by means of insert molding the corresponding fastening portions in the first insulating body and the second signal terminals are integrated with the second insulating body by means of insert molding the corresponding fastening portions in the second insulating body. The flexible portions are elastically received in the corresponding passing holes to make the contacting portions of the first signal terminals and the second signal terminals substantially face-to-face stretch into the inserting mouth of the insulating housing.

As described above, the first signal terminals and the second signal terminals are respectively fixed in the first insulating body and the second insulating body by means of insert molding instead of assembling shown in the prior art. Furthermore, the position that the first fastening portions of the first signal terminals are fixed in a mold can be easily and exactly controlled when operators pour melting dielectric material into the mold to form the first insulating body. Meanwhile, the position that the second fastening portions of the second signal terminals are fixed in the mold can be easily and exactly controlled when operators pour the melting dielectric material into the mold to form the second insulating body as well. Such manners can make the process of manufacturing the HDMI connector simpler and easier. As a result, the finished HDMI connector can be greatly promoted.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
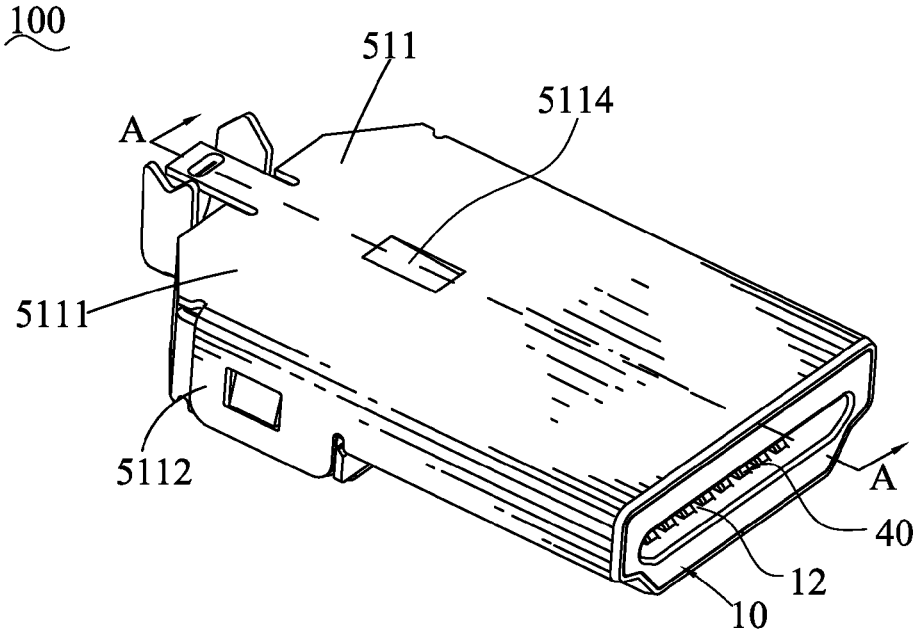
FIG. 1 is an assembled, perspective view of an HDMI connector of an embodiment in accordance with the present invention.
Figure 2:
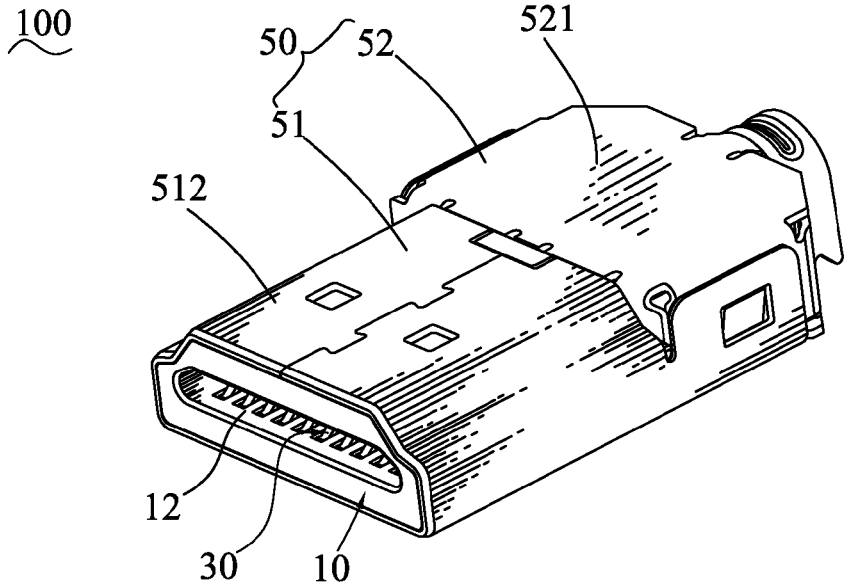
FIG. 2 is an assembled, perspective view of the HDMI connector of FIG. 1 viewed from another angle.
Figure 3:
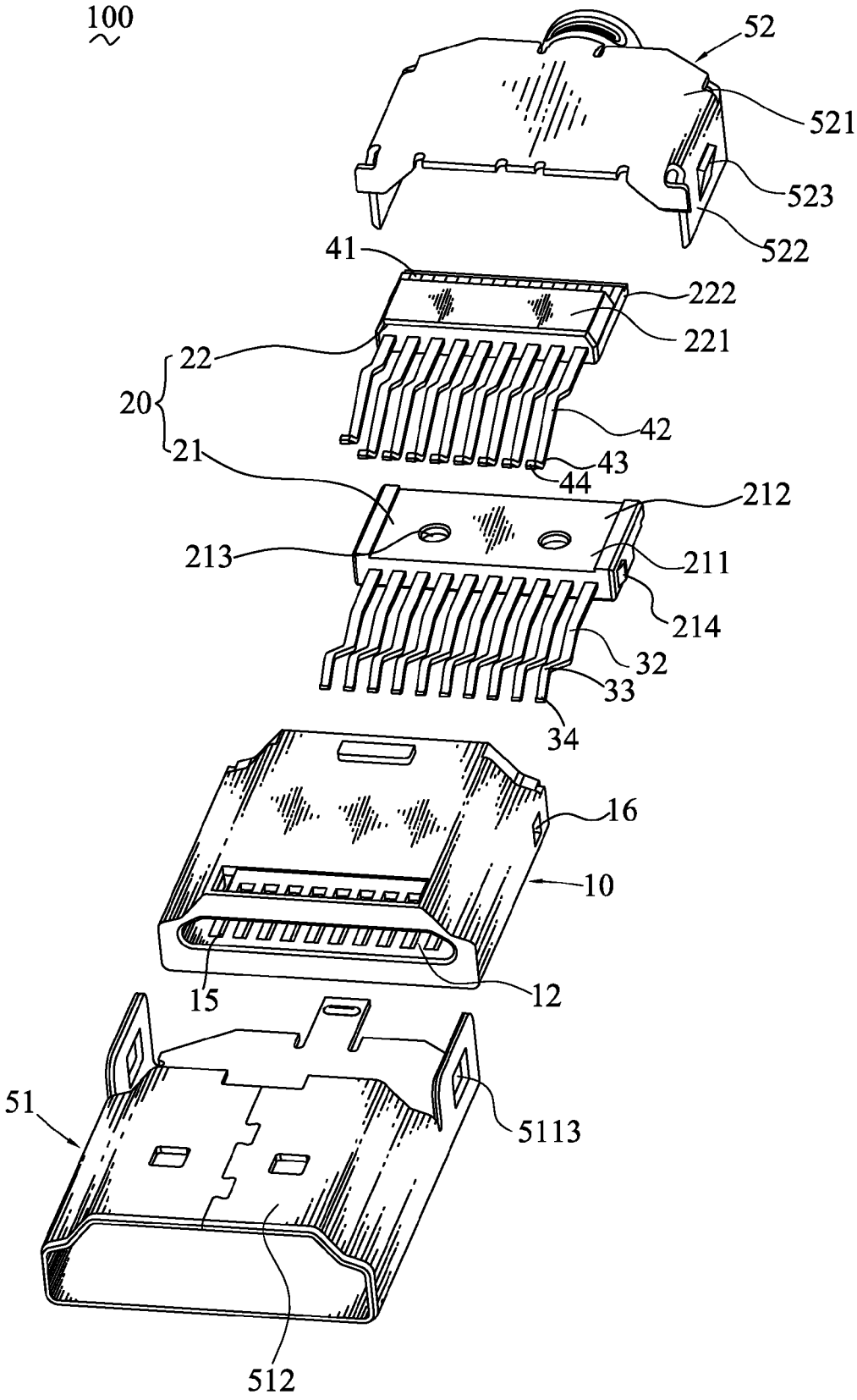
FIG. 3 is an exploded, perspective view of the HDMI connector shown in FIG. 1.
Figure 4:
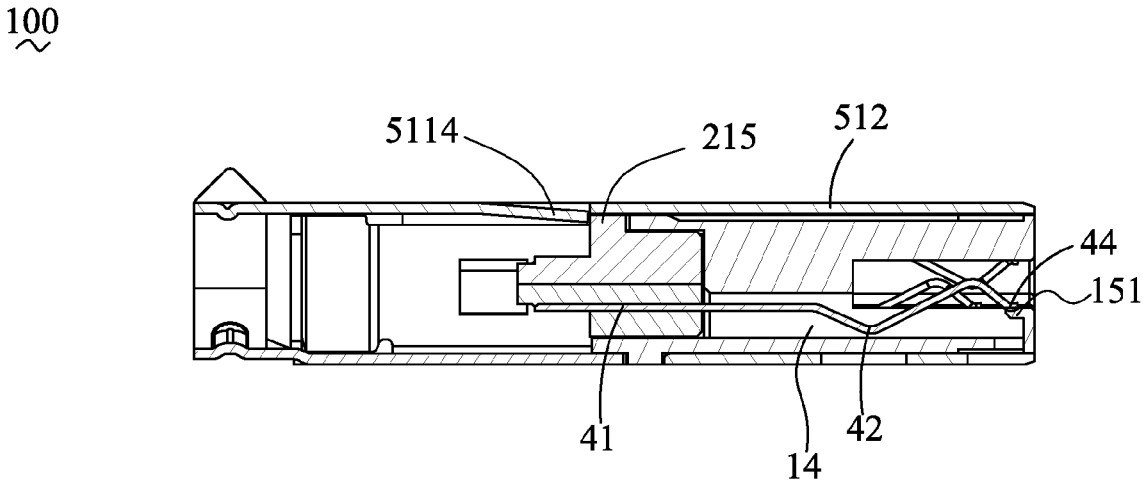
FIG. 4 is a cross-sectional view of the HDMI connector along a line A-A direction shown in FIG. 1.
Figure 5:
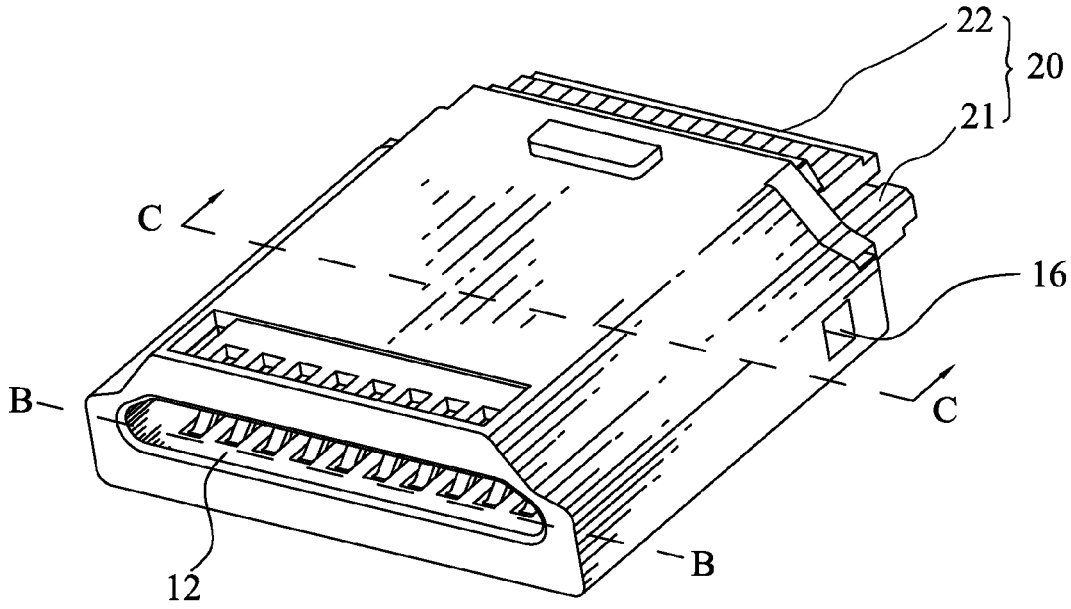
FIG. 5 is a partly assembled perspective view of the HDMI connector of FIG. 1 excluding an shielding shell, showing an insulating housing, a first insulating body, a plurality of first signal terminals, a second insulating body and a plurality of second signal terminals assembled together.
Figure 6:
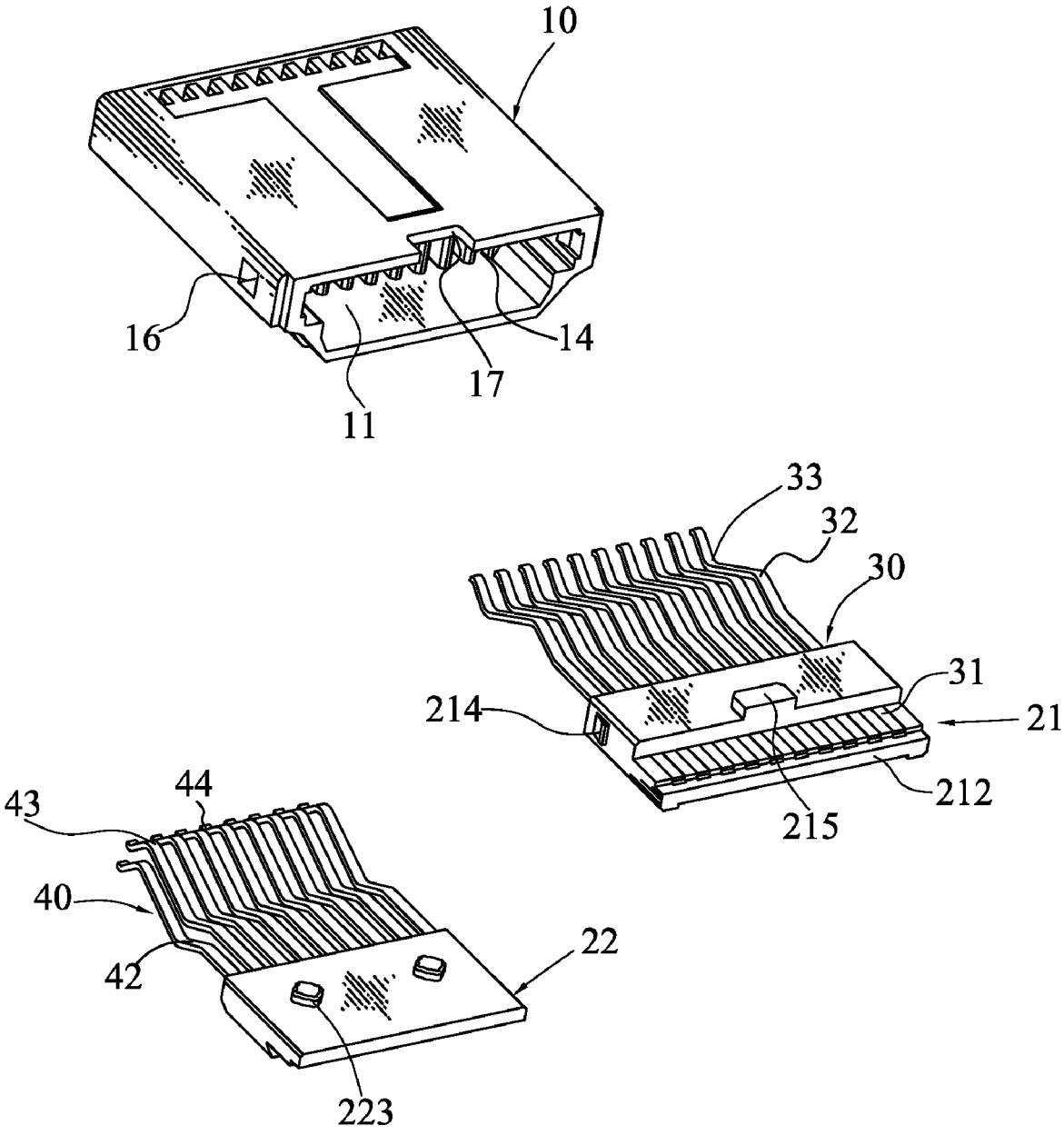
FIG. 6 is a partly exploded, perspective view of the HDMI connector without the shielding shell of FIG. 5, showing the insulating housing, the first insulating body with the first signal terminals integrated therein and the second insulating body with the second signal terminals integrated therein.
Figure 7:
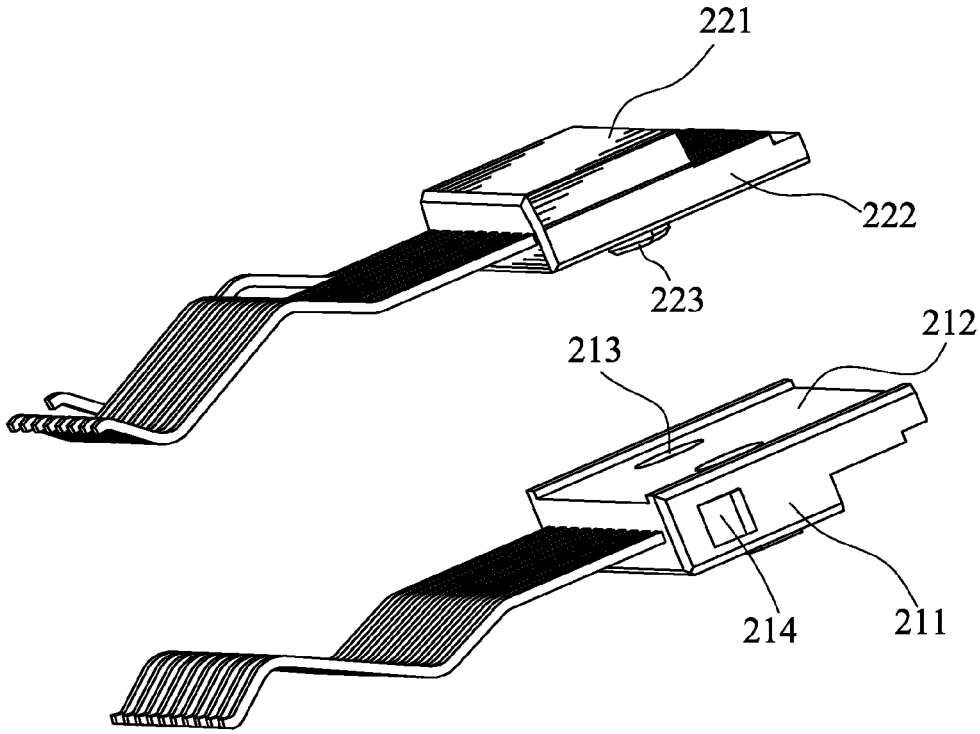
FIG. 7 is a partly exploded, perspective view of the HDMI connector without the shielding shell and the insulating housing, showing the first insulating body with the first signal terminals integrated therein and the second insulating body with the second signal terminals integrated therein.
Figure 8:
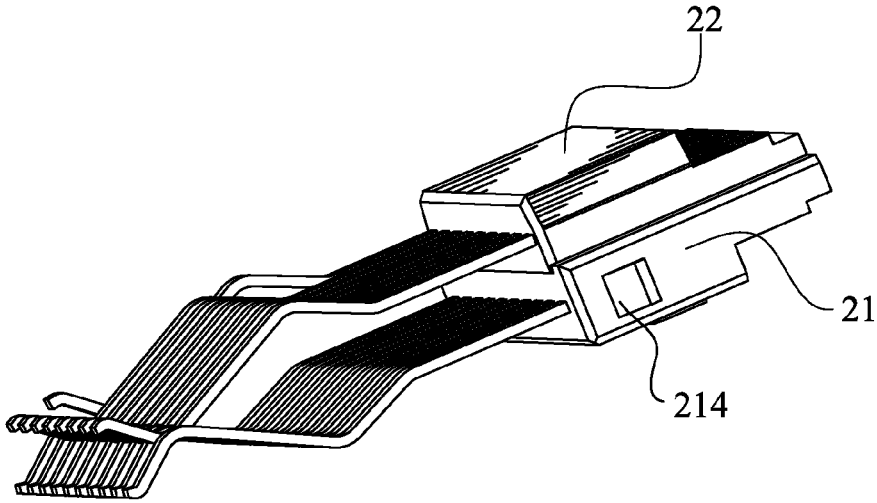
FIG. 8 is a partly assembled, perspective view of the HDMI connector without the shielding shell and the insulating housing shown in FIG. 7, wherein the first insulating body with the first signal terminals integrated therein and the second insulating body with the second signal terminals integrated therein are engaged with each other.
Figure 9:
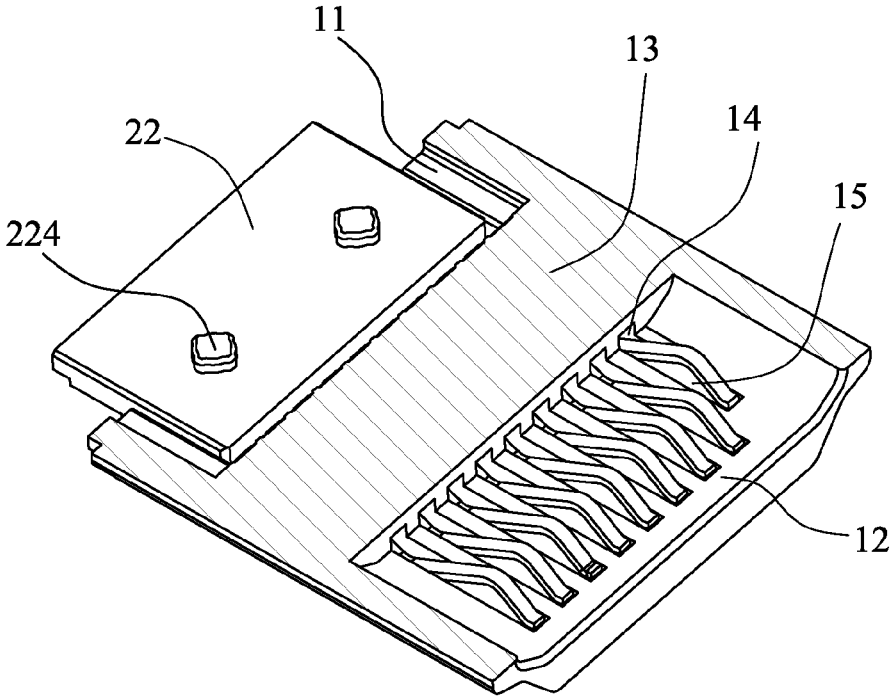
FIG. 9 is an upper view of FIG. 5 taken along a line B-B direction.
Figure 10:
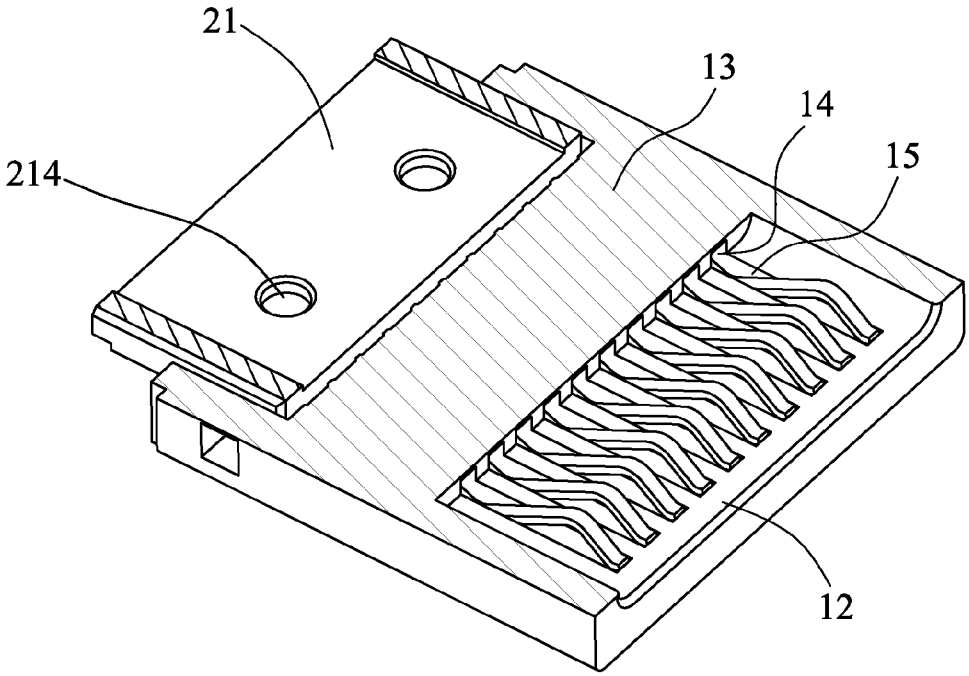
FIG. 10 is a lower view of FIG. 5 taken along the line B-B direction.
Figure 11:
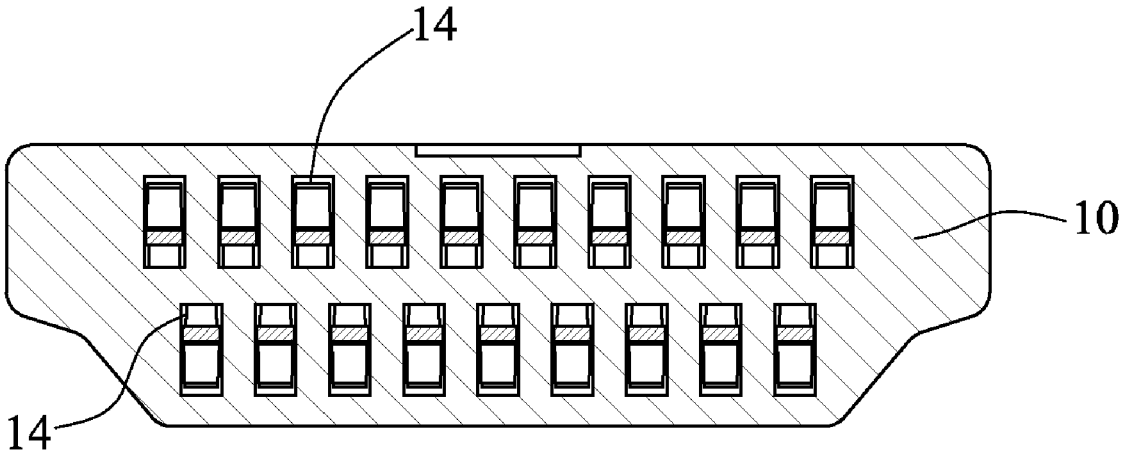
FIG. 11 is a cross-sectional view of FIG. 5 taken along a line C-C direction.

Referring to the drawings in greater detail, and first to FIG. 51-3, the embodiment of the invention is embodied in an HDMI connector 100. The HDMI connector 100 has an insulating housing 10, an insulating body 20, a plurality of first signal terminals 30, a plurality of second signal terminals 40 and a shielding shell 50.

Referring to FIGS. 3-4, FIG. 6 and FIGS. 9-11, the insulating housing 10 is of substantial rectangular shape. The insulating housing 10 has a receiving cavity 11 opened at one end thereof and an inserting mouth 12 opened at the other end thereof and opposite to the receiving cavity 11. In this embodiment, the inserting mouth 12 and the receiving cavity 11 are respectively opened at a front end and a rear end of the insulating housing 10. A connecting body 13 is formed between the receiving cavity 11 and the inserting mouth 12, and defines two rows of passing holes 14 each extending along a front-to-rear direction to connect the receiving cavity 11 with the inserting mouth 12. Each row of passing holes 14 are arranged at regular intervals along a direction perpendicular to the front-to-rear direction of the insulating housing 10. The upper row of passing holes 14 are staggered with the lower row of passing holes 14. A top side and a bottom side of the inserting mouth 12 respectively define a plurality of terminal grooves 15 each connected with the corresponding passing holes 14. A front side of each terminal groove 15 protrudes rearward to form a propping portion 151 adjacent to the inserting mouth 12. A pair of fixing fillisters 16 is opened at two opposite sides of the receiving cavity 11, and a gap 17 is opened at a substantial middle of a rear end of a bottom side of the receiving cavity 11.

Referring to FIGS. 6-10, the insulating body 20 has a first insulating body 21 and a second insulating body 22 engaged with the first insulating body 21. The first insulating body 21 has a rectangular first base portion 211 and a first bearing portion 212 extending rearward from a top of a rear end of the first base portion 211. The first base portion 211 defines a pair of locating holes 213 in a top surface thereof and spaced from each other. Two opposite side surfaces of the first base portion 211 protrude outward to form a fixing block 214 respectively. A substantial middle of a rear end of a bottom surface of the first base portion 211 protrudes downward to form a preventing projection 215 for being buckled in the gap 17 of the insulating housing 10. The second insulating body 22 has a substantial similar structure to the first insulating body 21 and has a second base portion 221 and a second bearing portion 222. The main difference between the first insulating body 21 and the second insulating body 22 is that the second base portion 221 has a pair of locating pillars 223 protruded downward at a bottom surface thereof and spaced from each other for being inserted in the corresponding locating holes 213 of the first insulating body 21.

With reference to FIG. 3, FIG. 4, FIG. 6 and FIGS. 9-11, the first signal terminal 30 has a strip-shaped first fastening portion 31, a first contacting portion 33 and a first flexible portion 32 connecting the first fastening portion 31 with the first contacting portion 33. One end of the first flexible portion 32 of the first signal terminal 30 adjacent to the first contacting portion 33 is arched substantially perpendicularly to the other end of the first flexible portion 32 to show a V-shape. The first contacting portion 33 is arched towards a direction opposite to the arched direction of the one end of the first flexible portion 32 to show an inverted-V shape. A distal end of the first contacting portion 33 slightly extends oppositely to the first flexible portion 32 to form a first resisting end 34. The second signal terminal 40 has a same structure as the first signal terminal 30, and has a second fastening portion 41, a second flexible portion 42, a second contacting portion 43 and a second resisting end 44.

Referring to FIGS. 1-4, the shielding shell 50 includes a main shell 51 and an upper cover 52 matching with the main shell 51. The main shell 51 has a lower cover 511 and a front shell 512 connecting with a front end of the lower cover 511. The lower cover 511 has a base board 5111 and two side boards 5112 extending upward from two opposite side edges of the base board 5111. Each side board 5112 of the lower cover 511 defines a fixing hole 5113. A middle portion of the front end of the base board 5111 is punched inward to form a blocking piece 5114 adjacent to the front shell 512. The upper cover 52 has a base plate 521 and two lateral plates 522 extending downward from two opposite side edges of the base plate 521. Each lateral plate 522 of the upper cover 52 is punched outward to form a buckling piece 523 for being secured in the fixing hole 5113 of the lower cover 511.

Referring to FIGS. 2-5, the first signal terminals 30 are integrated with the first insulating body 21 by means of insert molding the first fastening portions 31 in the first insulating body 21 with tips of the first contacting portions 33 being in alignment with one another, and rear ends of the first fastening portions 31 are embedded in the first bearing portion 212 and further exposed out of a bottom surface of the first bearing portion 212. The second signal terminals 40 are integrated with the second insulating body 22 by means of insert molding the second fastening portions 41 in the second insulating body 22 with tips of the second contacting portions 43 being in alignment with one another, and rear ends of the second fastening portions 41 are embedded in the second bearing portion 222 and further exposed out of a top surface of the second bearing portion 222. The first insulating body 21 is engaged with the second insulating body 22 by means of the locating pillars 223 of the second insulating body 22 being located in the locating holes 213 of the first insulating body 21 respectively, wherein the tips of the first contacting portions 33 are substantially aligned with the tips of the second contacting portions 43. The insulting body 20 is secured in the receiving cavity 11 of the insulating housing 10, with the fixing block 214 of the first insulating body 21 being buckled in the fixing fillister 16 of the insulating housing 10. The preventing projection 215 of the first insulating body 21 is fixed in the gap 17 of the insulating housing 10. The first bearing portion 212 and the second bearing portion 222 further project beyond a rear of the insulating housing 10. The first flexible portion 32 of the first signal terminal 30 and the second flexible portion 42 of the second signal terminal 40 are elastically received in the corresponding passing holes 14 to make the first and the second contacting portions 33, 43 substantially face-to-face stretch into the inserting mouth 12 of the insulating housing 10. The first resisting ends 34 of the first signal terminals 30 abut against the corresponding propping portions 151 to ensure the tips of the first contacting portions 33 being arranged with the same height, and the second resisting ends 44 of the second signal terminals 40 abut against the corresponding propping portions 151 to ensure the tips of the second contacting portions 43 being arranged with the same height. The insulating housing 10 is received in the front shell 512 of the main shell 51, with the blocking piece 5114 of the lower cover 511 resisting against a rear end of the preventing projection 215 of the first insulating body 21 to further restrain the preventing projection 215 in the gap 17. The upper cover 52 is mated with the lower cover 511 by means of the buckling pieces 523 of the upper cover 52 being buckled in the fixing holes 5113 of the lower cover 511, to make the first bearing portion 212 and the second bearing portion 222 enclosed between the upper cover 52 and the lower cover 511.

As described above, the first signal terminals 30 and the second signal terminals 40 are respectively fixed in the first insulating body 21 and the second insulating body 22 by means of insert molding instead of assembling in the prior art. Furthermore, the position that the first fastening portions 31 of the first signal terminals 30 are fixed in a mold (not shown) can be easily and exactly controlled when operators pour melting dielectric material into the mold to form the first insulating body 21. Meanwhile, the position that the second fastening portions 41 of the second signal terminals 40 are fixed in the mold can be easily and exactly controlled when operators pour the melting dielectric material into the mold to form the second insulating body 22 as well. Such manners can make the process of manufacturing the HDMI connector 100 simpler and easier. As a result, the finished HDMI connector 100 can be greatly promoted.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An HDMI (High Definition Multimedia Interface) connector, comprising:

an insulating housing having a receiving cavity opened at one end thereof and an inserting mouth opened at the other end thereof and opposite to the receiving cavity, a connecting body being formed between the receiving cavity and the inserting mouth, and defining two rows of passing holes each connecting the receiving cavity with the inserting mouth;

an insulating body secured in the receiving cavity of the insulating housing, the insulating body including a first insulating body and a second insulating body engaged with the first insulating body; and a plurality of first signal terminals and a plurality of second signal terminals, each terminal having a fastening portion, a contacting portion and a flexible portion connecting the fastening portion with the contacting portion, the first signal terminals being integrated with the first insulating body by means of insert molding the corresponding fastening portions in the first insulating body and the second signal terminals being integrated with the second insulating body by means of insert molding the corresponding fastening portions in the second insulating body, the flexible portions being elastically received in the corresponding passing holes to make the contacting portions of the first signal terminals and the second signal terminals substantially face-to-face stretch into the inserting mouth of the insulating housing.

2. The HDMI connector as claimed in claim 1, wherein the first insulating body defines a pair of locating holes in a top surface thereof and spaced from each other, the second insulating body defines a pair of locating pillars protruded downward at a bottom surface thereof and spaced from each other to be engaged in the corresponding locating holes of the first insulating body.

3. The HDMI connector as claimed in claim 1, wherein two opposite side surfaces of the insulating body protrude outward to form a fixing block respectively, a pair of fixing fillisters is opened at two opposite sides of the receiving cavity for buckling the corresponding fixing blocks therein.

4. The HDMI connector as claimed in claim 1, wherein the first insulating body has a first base portion and a first bearing portion extending rearward from a rear end of the first base portion, the second insulating body has a second base portion and a second bearing portion extending rearward from a rear end of the second base portion, the first bearing portion and the second bearing portion further project beyond a rear of the insulating housing for propping rear ends of the fastening portions.

5. The HDMI connector as claimed in claim 1, wherein front ends of the flexible portions of the first signal terminal and the second signal terminal are arched away from each other to show a substantial V-shape respectively.

6. The HDMI connector as claimed in claim 1, wherein the contacting portions of the first signal terminal and the second signal terminal are arched near to each other to show a substantial V-shape respectively.

7. The HDMI connector as claimed in claim 6, wherein a distal end of each contacting portion slightly extends frontward to form a resisting end, a top side and a bottom side of the inserting mouth respectively define a plurality of terminal grooves each connected with the corresponding passing hole, a front side of each terminal groove protrudes rearward to form a propping portion adjacent to the inserting mouth, the resisting ends of the first signal terminals and the second signal terminals abut against the corresponding propping portions to ensure tips of the contacting portions being arranged with a substantial same height.

8. The HDMI connector as claimed in claim 1, wherein each row of passing holes are arranged at regular intervals along a direction perpendicular to a front-to-rear direction of the insulating housing, the upper row of passing holes are staggered with the lower row of passing holes.

9. The HDMI connector as claimed in claim 1, wherein the HDMI connector further includes a shielding shell enclosing the insulating housing.

10. The HDMI connector as claimed in claim 9, wherein a gap is opened at a rear end of a bottom side of the receiving cavity, a portion of a bottom surface of the first insulating body protrudes oppositely to the second insulating body to form a preventing projection buckled in the gap of the insulating housing, the shielding shell defines a blocking piece punched inward to resist against the preventing projection and further restrain the preventing projection in the gap.

* * * * *